US006701838B2

(12) United States Patent
Kolbe et al.

(10) Patent No.: US 6,701,838 B2
(45) Date of Patent: Mar. 9, 2004

(54) ENGRAVED TRANSFER CYLINDER FOR A FLEXOGRAPHIC PRINTING PRESS

(75) Inventors: Wilfried Kolbe, Gülzow (DE); Klaus Schirrich, Bielefeld (DE); Manfred Terstegen, Bielefeld (DE); Bodo Steinmeier, Bielefeld (DE)

(73) Assignee: Fischem & Krecke GmbH & Co., Bielefeld (DE)

( * ) Notice: Subject to any disclaimer, the term of this patent is extended or adjusted under 35 U.S.C. 154(b) by 0 days.

(21) Appl. No.: 09/776,098

(22) Filed: Feb. 2, 2001

(65) Prior Publication Data

US 2001/0013288 A1 Aug. 16, 2001

(30) Foreign Application Priority Data

Feb. 10, 2000 (EP) ..... 00102728

(51) Int. Cl.[7] ..... B41F 31/26
(52) U.S. Cl. ..... 101/348; 101/352.11; 492/50
(58) Field of Search ..... 101/348, 352.11, 101/352.13; 492/30, 50, 53

(56) References Cited

U.S. PATENT DOCUMENTS

| | | | | |
|---|---|---|---|---|
| 3,378,902 A | | 4/1968 | Hoexter | 101/375 |
| 4,119,032 A | * | 10/1978 | Hollis | 101/216 |
| 4,407,199 A | | 10/1983 | Moss | 101/375 |
| 5,370,047 A | | 12/1994 | Compton | 101/216 |
| 5,454,311 A | * | 10/1995 | Reffert | 101/216 |
| 5,660,109 A | * | 8/1997 | Constantino et al. | 101/348 |
| 5,786,051 A | * | 7/1998 | Niggemeier et al. | 492/31 |
| 5,816,154 A | * | 10/1998 | Stuart | 101/216 |
| 5,857,950 A | * | 1/1999 | Hycner | 492/30 |
| 6,523,470 B2 | * | 2/2003 | Kolbe et al. | 101/375 |

FOREIGN PATENT DOCUMENTS

| | | |
|---|---|---|
| DE | 3525045 | 1/1987 |
| DE | 4426485 | 11/1995 |
| DE | 29609007 | 8/1996 |

* cited by examiner

*Primary Examiner*—Stephen R. Funk
(74) *Attorney, Agent, or Firm*—Richard M. Goldberg

(57) ABSTRACT

An engraved ink transfer cylinder for a flexographic printing press, wherein the roller body (12) is clamped detachably on a continuous axle (22) and surrounds this axle (22) at a distance.

4 Claims, 1 Drawing Sheet

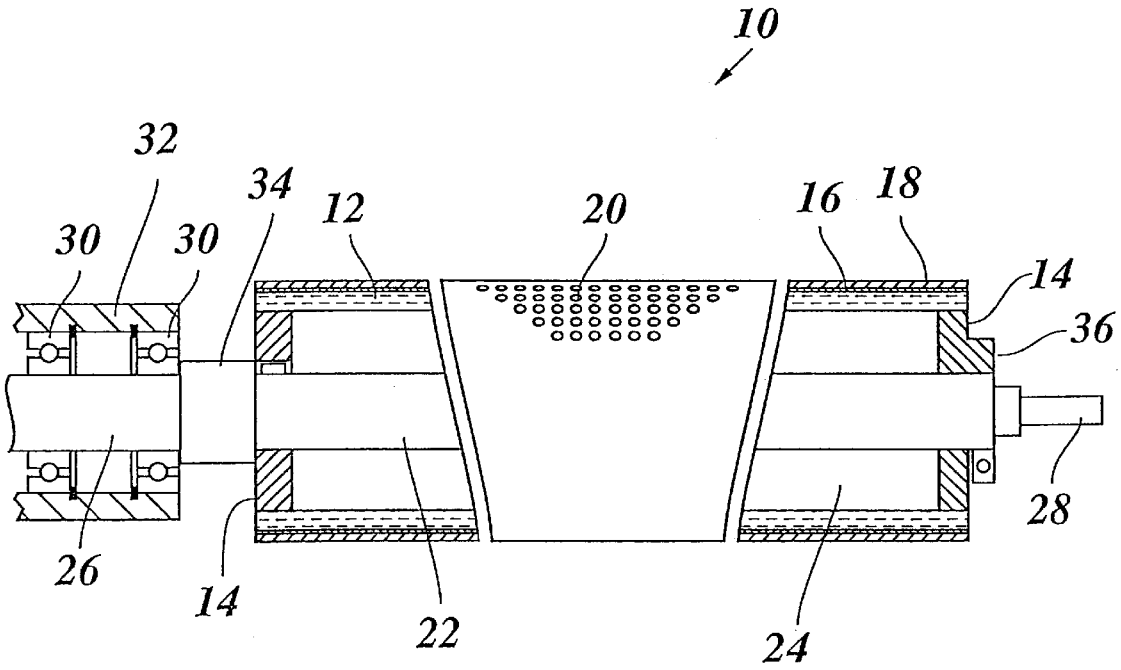
10
32
34
12
20
16
18
30
30
14
36
26
14
22
24
28

ENGRAVED TRANSFER CYLINDER FOR A FLEXOGRAPHIC PRINTING PRESS

BACKGROUND OF THE INVENTION

The invention relates to an engraved ink transfer cylinder for a flexographic printing press and to a flexographic printing press with such an engraved ink transfer cylinder.

In flexographic printing presses, engraved ink transfer cylinders take up the printing ink from a chamber doctor blade and transfer it to an impression cylinder rolling along the periphery of the engraved ink transfer cylinder. Until now, such engraved ink transfer cylinders were usually formed by a metal cylinder, which has a ceramic layer on its peripheral surface and in the outer surface of which a fine screen of flat cells is formed, which are filled with printing ink as they pass through the chamber doctor blade and then transfer the printing ink to the impression cylinder. Until now, the bearings have been constructed by axle journals, which are formed in one piece at the two ends of the metal cylinder.

The outer diameter of the impression cylinder depends on the desired printing length. Therefore, if the printing press is to be re-equipped for a new printing process, the impression cylinder usually must be exchanged. The diameter of the engraved ink transfer cylinder does not depend on the desired printing length and generally is smaller than the diameter of the impression cylinder. For different printing orders, however, different engraved ink transfer cylinders are frequently used, which differ in the nature of the cell screen. For this reason, the engraved ink transfer cylinder of a printing press must also be exchanged frequently.

Impression cylinders frequently are constructed as hollow cylinders, which are closed off at both ends; an axle passes through the two ends and the impression cylinder can be clamped hydraulically onto the axle (U.S. Pat. No. 3,378,902). In the European patent application 99 102 033, an impression cylinder is proposed, the outer jacket of which is formed by a casing of a carbon fiber composite material with a rolled framework of carbon fibers. By these means, a saving in weight is achieved without loss of mechanical strength and, with that, the exchanging of the impression cylinder is facilitated.

In the European patent application 98 123 726, a robot is described for exchanging the cylinder of a printing press. By means of this robot, which can be used not only for exchanging the impression cylinder, but also for exchanging the engraved ink transfer cylinder, the cylinder to be exchanged is held only at one end in cantilever fashion. If the sheet of material, which is to be printed, has a very large width and the impression cylinder and engraved ink transfer cylinder must be correspondingly long, large mechanical stresses occur at the holding mechanism of the robot. For this reason, it is also desirable to reduce the weight of the engraved ink transfer cylinder as much as possible.

SUMMARY OF THE INVENTION

It is therefore an object of the invention, to provide an engraved ink transfer cylinder, which has the least possible weight for a given mechanical strength.

Pursuant to the invention, this objective is accomplished owing to the fact that the roller body of the engraved ink transfer cylinder is clamped detachably on a continuous axle and surrounds this axle at a distance.

Due to this two-part construction, the weight of the engraved ink transfer cylinder is reduced appreciably.

Nevertheless, a high mechanical strength is achieved, since the axle is reinforced by the roller body, which surrounds this axle at a distance. A further advantage of this solution consists therein that the roller body can be detached from the axle and replaced by a different roller body with a different cell screen. During this procedure, the axle can remain in the printing press. In order to make a suitable selection of cell screens possible, it therefore suffices to keep an appropriate assortment of roller bodies in stock, which can then be clamped on to one and the same axle as required. This not only reduces costs, but also decreases the weight of the storage area or storage carriage, used for keeping the assortment of roller bodies.

In a particularly preferred embodiment, the roller body is formed by a casing of carbon fiber-containing material, such as a carbon fiber composite material with a rolled framework of carbon fibers. Despite the lesser weight, the carbon fibers give the roller sufficient strength, so that it can surround the axle in cantilever fashion.

The roller body is disposed as an outermost casing and is detachably clamped on the axle and surrounds the axle so as to be spaced from the axle by a distance such that the roller body is self supporting, wherein the roller body can be pulled axially from the axle, and the roller body has a cylindrical casing of carbon fiber-containing material such that the roller body has sufficient rigidity to bear radial forces imparted thereon during a printing operation.

Spaced apart disks hold the roller body at a distance from a peripheral surface of the continuous axle, the disks being disposed in a region of two axial ends of the continuous axle such that the roller body is supported at at least two positions by the disks and such that a majority of length of the roller body is out of contact with any supporting member.

Preferably, the roller body is closed off at both ends by disks, which can also be displaced somewhat towards the inside and which can be clamped with their inner peripheral edge on the axle. The disks can be constructed in one piece with the roller body. Alternatively, however, they can also be produced separately from the roller body and from a different material and then connected non-rotationally with the roller body.

BRIEF DESCRIPTION OF THE DRAWINGS

In the following, an example is explained in greater detail by means of the drawings.

The FIGURE, containing a single drawing, shows a partially broken open side view of an engraved ink transfer cylinder.

DETAILED DESCRIPTION

The engraved ink transfer cylinder 10 has a roller body 12 in the form of a tubular casing of a carbon fiber composite material. Such tubular bodies of carbon fiber composite material have previously been used, for example, as sheet-guiding rollers in printing presses or optionally also as impression cylinders for smaller printing lengths. Typically, these tubular bodies have a framework of diagonally wound carbon fibers, which are embedded in a matrix of plastic.

The roller body 12 is closed off in the region of its two ends by disks 14, which consist of metal in the example shown and are connected non-rotationally with the roller body.

On the outer peripheral surface, the roller body 12 carries a metallic primer layer 16, which can be formed by metallizing the carbon fiber composite material. On the primer layer 16, a ceramic layer 18 is applied, on the outer surface of which a fine screen of cells 20 is formed in a known manner.

A continuous axle 22 of metal, the external diameter of which is clearly smaller than the internal diameter of the cylindrical roller body 12, passes through the disks 14. Accordingly, an annular cavity 24 is formed between the axle 22 and the roller body 12. Due to this construction and the slight inherent weight of the roller body 12, the total weight of the engraved ink transfer cylinder is reduced appreciably, so that even relatively long engraved ink transfer cylinders for printing widths of 2000 mm or more can be handled without problems.

At both ends, the axle 24 forms bearing sections 26, 28. The bearing section 26 is held stably in the frame 32 of the flexographic printing press by means of two bearings 30, while the bearing section 28 is held by a removable bearing, which is not shown. After this bearing is removed, the roller body 12 with the disks 14 can be pulled axially from the axle 22.

The axle 22 forms a stop 34 for one of the disks 14, which is wedged non-rotationally with the axle. The disk 14 on the side of the removable bearing is clamped detachably with a clamping bush 36 on the axle 22. The other disk 14 on the opposite side may also be clamped detachably with a clamping bush on the axle 22.

What is claimed is:

1. A flexographic printing press, comprising:

a frame;

a continuous axle rotatably mounted at one end firmly in the frame of the printing press by bearings and detachably mounted in an opposite end of the frame by bearings, a roller body disposed as an outermost casing with an exposed outer surface on the continuous axle, the roller body surrounding said axle so as to be spaced from the axle by a distance, the roller body having a cylindrical casing of carbon fiber composite material having a coiled framework of carbon fiber such that the roller body has sufficient rigidity to bear radial forces imparted thereon during a printing operation, and wherein the roller body is adapted to be pulled axially from the continuous axle, spaced apart disks for holding the roller body at a distance from a peripheral surface of the continuous axle, the disks being disposed in a region of two axial ends of the continuous axle such that said roller body is supported at at least two positions by said disks and such that a majority of length of said roller body is out of contact with any supporting member, which renders the roller body to be self supporting without any additional structure, the disks closing off the roller body at both ends, and a device which clamps at least one of the disks onto the axle.

2. A flexographic printing press according to claim 1, wherein the roller body includes a primer layer of metal on the cylindrical casing, and a ceramic layer on said primer layer with the exposed outer surface being formed by an outer surface of the ceramic layer.

3. A flexographic printing press according to claim 1, wherein the disks close off the roller body at both ends and said device clamps both disks onto the axle.

4. A flexographic printing press comprising:

a frame;

a continuous axle rotatably mounted at one end firmly in the frame of the printing cress by bearings and detachably mounted in an opposite end of the frame by bearings, a roller body disposed as an outermost casing with an exposed outer surface on the continuous axle, the roller body surrounding said axle so as to be spaced from the axle by a distance, the roller body having cylindrical casing of carbon fiber-containing material such that the roller body has sufficient rigidity to bear radial forces imparted thereon during a printing operation, and wherein the roller body is adapted to be pulled axially from the continuous axle, spaced apart disks for holding the roller body at a distance from a peripheral surface of the continuous axle, the disks being disposed in a region of two axial ends of the continuous axle such that said roller body is supported at at least two positions by said disks and such that a majority of length of said roller body is out of contact with any supporting member, which renders the roller body to be self supporting without any additional structure, and the disks close off the roller body at both ends, and a device which clamps at only one of the disks onto the axle.

* * * * *

UNITED STATES PATENT AND TRADEMARK OFFICE

CERTIFICATE OF CORRECTION

PATENT NO. : 6,701,838 B2
DATED : March 9, 2004
INVENTOR(S) : Wilfried Kolbe et al.

It is certified that error appears in the above-identified patent and that said Letters Patent is hereby corrected as shown below:

Title page,
Item [73], Assignee, please change the name to read -- Fischer & Krecke GmbH & Co. --

Signed and Sealed this

Eighth Day of June, 2004

JON W. DUDAS
*Acting Director of the United States Patent and Trademark Office*